US008328182B2

(12) United States Patent
Iino

(10) Patent No.: US 8,328,182 B2
(45) Date of Patent: Dec. 11, 2012

(54) IMAGE FORMING APPARATUS

(75) Inventor: Hikaru Iino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/978,928

(22) Filed: Dec. 27, 2010

(65) Prior Publication Data

US 2011/0156342 A1 Jun. 30, 2011

(30) Foreign Application Priority Data

Dec. 28, 2009 (JP) ..... 2009-298326

(51) Int. Cl.
*B65H 3/06* (2006.01)

(52) U.S. Cl. ..... 271/117

(58) Field of Classification Search ..... 271/117
See application file for complete search history.

(56) References Cited

U.S. PATENT DOCUMENTS 5,060,926 A * 10/1991 Murai et al. ..... 271/111
5,294,104 A * 3/1994 Nishigaki ..... 271/117
5,975,517 A * 11/1999 Lim ..... 271/117
2006/0113722 A1 6/2006 Hattori
2006/0180986 A1 8/2006 Hattori
2006/0180987 A1 8/2006 Hattori
2006/0267269 A1 11/2006 Yano et al.
2007/0158901 A1* 7/2007 Lee ..... 271/171
2008/0128973 A1 6/2008 Hirose
2009/0079126 A1* 3/2009 Hattori ..... 271/117

FOREIGN PATENT DOCUMENTS

JP 61002632 A * 1/1986
JP 03026619 A * 2/1991
JP 05085629 A * 4/1993

* cited by examiner

*Primary Examiner* — Prasad Gokhale
(74) *Attorney, Agent, or Firm* — Banner & Witcoff, Ltd.

(57) ABSTRACT

An image forming apparatus includes an image forming unit, a first main body frame and a second main body frame, a sheet placing portion, a feed roller, a link arm and a bridge frame. The feed roller moves with the link arm. The bridge frame is configured to join the first main body frame with the second main body frame and to swingably support the link arm. The link arm is movable between a temporary mounting position, in which the entirety of the link arm is positioned between the first main body frame and the second main body frame, and a final mounting position, in which the link arm is supported by the bridge frame and cooperates with the feed roller. At least one of the link arm and the bridge frame is positioned with holding mechanism configured to hold the link arm in the temporary mounting position.

19 Claims, 9 Drawing Sheets

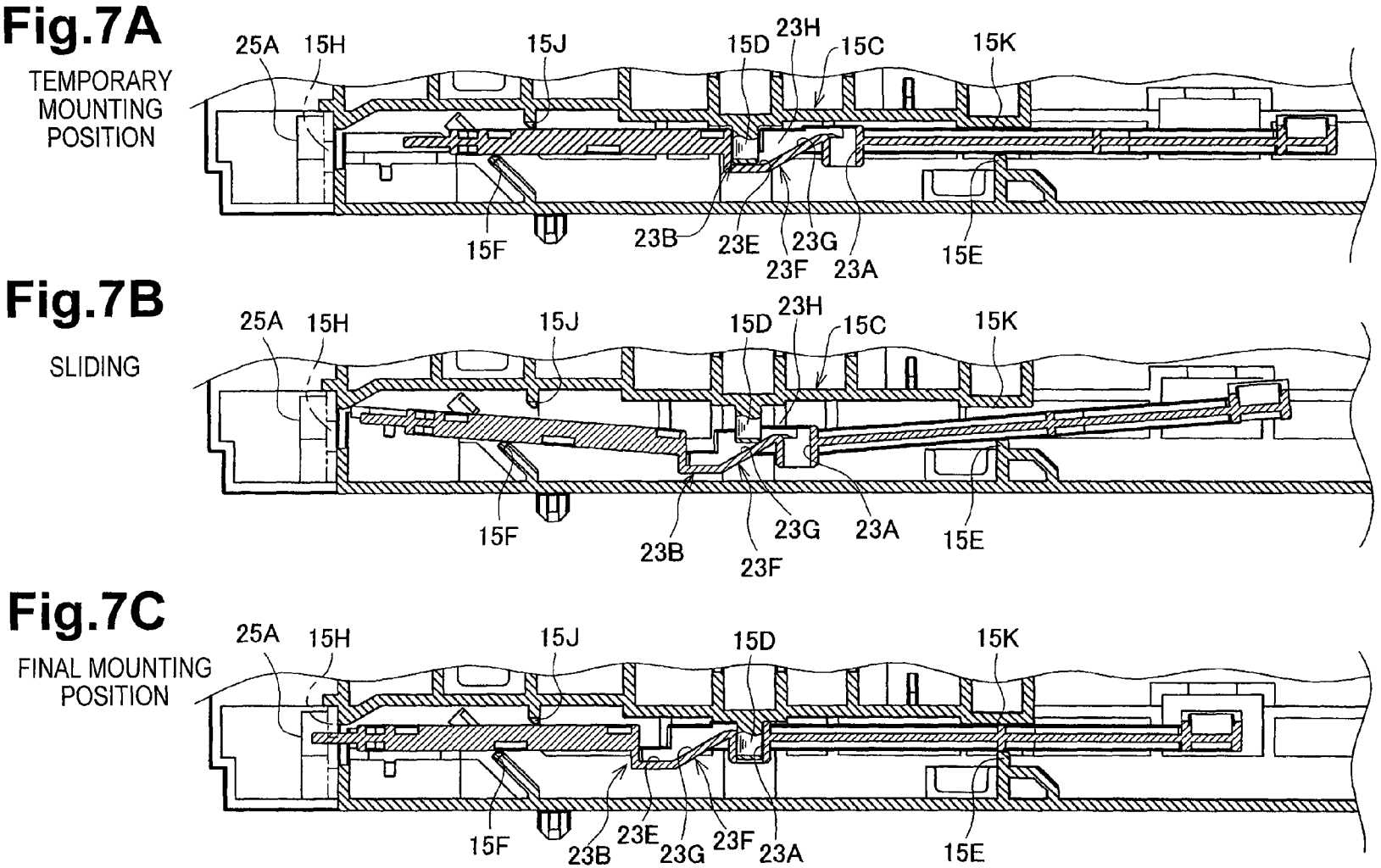
Fig.7A TEMPORARY MOUNTING POSITION
Fig.7B SLIDING
Fig.7C FINAL MOUNTING POSITION

PICK-UP ROLLER SIDE
23
23J
23A
23F
23G
23H
23C
23B
A
A
DRIVE MECHANISM SIDE

DRIVE MECHANISM SIDE
23B
23F
23A
23
23J
PICK-UP ROLLER SIDE
UP-DOWN DIRECTION
LONGITUDINAL DIRECTION (WIDTH DIRECTION)
AXIS DIRECTION (FRONT-REAR DIRECTION)

15C
23C
15D
23D
23
23B
23E
A-A SECTIONAL VIEW

IMAGE FORMING APPARATUS

CROSS REFERENCE TO RELATED APPLICATION

The present application claims priority from Japanese Patent Application No. 2009-298326, which was filed on Dec. 28, 2009, the disclosure of which is incorporated herein by reference in its entirety. The disclosure of U.S. Pat. No. 7,516,954 is incorporated herein by reference in its entirety.

BACKGROUND

1. Field of the Invention

The present invention relates to an image forming apparatus for forming an image on a recording sheet.

2. Description of the Related Art

An image forming apparatus in which a link arm moves with a pick-up roller is known. The link arm extends to a drive mechanism and switches transmission of the drive force from the drive mechanism to the pick-up roller.

When the link arm is mounted on the main body, it is necessary to add force to bend the link arm. Thus, the link arm cannot be so readily mounted.

SUMMARY

A need has arisen to provide an image forming apparatus which the link arm can be more readily mounted in a more reliable manner.

According to an embodiment of the present invention, an image forming apparatus includes an image forming unit, a first main body frame and a second main body frame, a sheet placing portion, a feed roller, a link arm and a bridge frame. The image forming unit is configured to form an image. The first main body frame and the second main body frame is disposed to hold the image forming unit therebetween. The sheet placing portion is disposed between the first main body frame and the second main body frame and configured to place the recording sheet thereon. The feed roller is configured to feed the recording sheet placed on the sheet placing portion toward the image forming unit and to move relative to the sheet placing portion. The link arm is configured to extend through the first main body frame from a side of the sheet placing portion to a side opposite the sheet placing portion across the first main body frame, and the feed roller moves with the link arm. The bridge frame is configured to extend to join the first main body frame with the second main body frame and to swingably support the link arm. The link arm is movable between a temporary mounting position, in which the entirety of the link arm is positioned between the first main body frame and the second main body frame, and a final mounting position, which offsets from the temporary mounting position in a longitudinal direction of the link arm and in which the link arm is supported by the bridge frame and cooperates with the feed roller. At least one of the link arm and the bridge frame is positioned with holding mechanism configured to hold the link arm in the temporary mounting position.

According to another embodiment of the present invention, an image forming apparatus includes an image forming unit, a first main body frame and a second main body frame, a sheet placing portion, a feed roller, a link arm and a bridge frame. The image forming unit is configured to form an image. The first main body frame and the second main body frame is disposed to hold the image forming unit therebetween. The sheet placing portion is disposed between the first main body frame and the second main body frame and configured to place the recording sheet thereon. The feed roller is configured to feed the recording sheet placed on the sheet placing portion toward the image forming unit and to move relative to the sheet placing portion. The feed roller moves with the link arm. The bridge frame is configured to extend to join the first main body frame with the second main body frame and to swingably support the link arm. The link arm is movable between a first position and a second position which offsets from the first position in a longitudinal direction of the link arm and in which the link arm is supported by the bridge frame and cooperates with the feed roller.

BRIEF DESCRIPTION OF THE DRAWINGS

FIG. 7A is a sectional view illustrating the final mounting position of the lift arm that is mounted on the sheet feed frame of the image forming apparatus according to the embodiment of the present invention. FIG. 7B is a sectional view illustrating an intermediate stage in mounting the lift arm on the sheet feed frame of the image forming apparatus according to the embodiment of the present invention. FIG. 7C is a sectional view illustrating the temporary mounting position of the lift arm to be mounted on the sheet feed frame of the image forming apparatus according to the embodiment of the present invention.

DESCRIPTION OF THE PREFERRED EMBODIMENTS

An image forming apparatus according to embodiments of the present invention, which is an electrophotographic image forming apparatus, will be described below with reference to the drawings.

First Embodiment

1. General Configuration of Image Forming Apparatus (Refer to FIG. 1)

Figure 1:
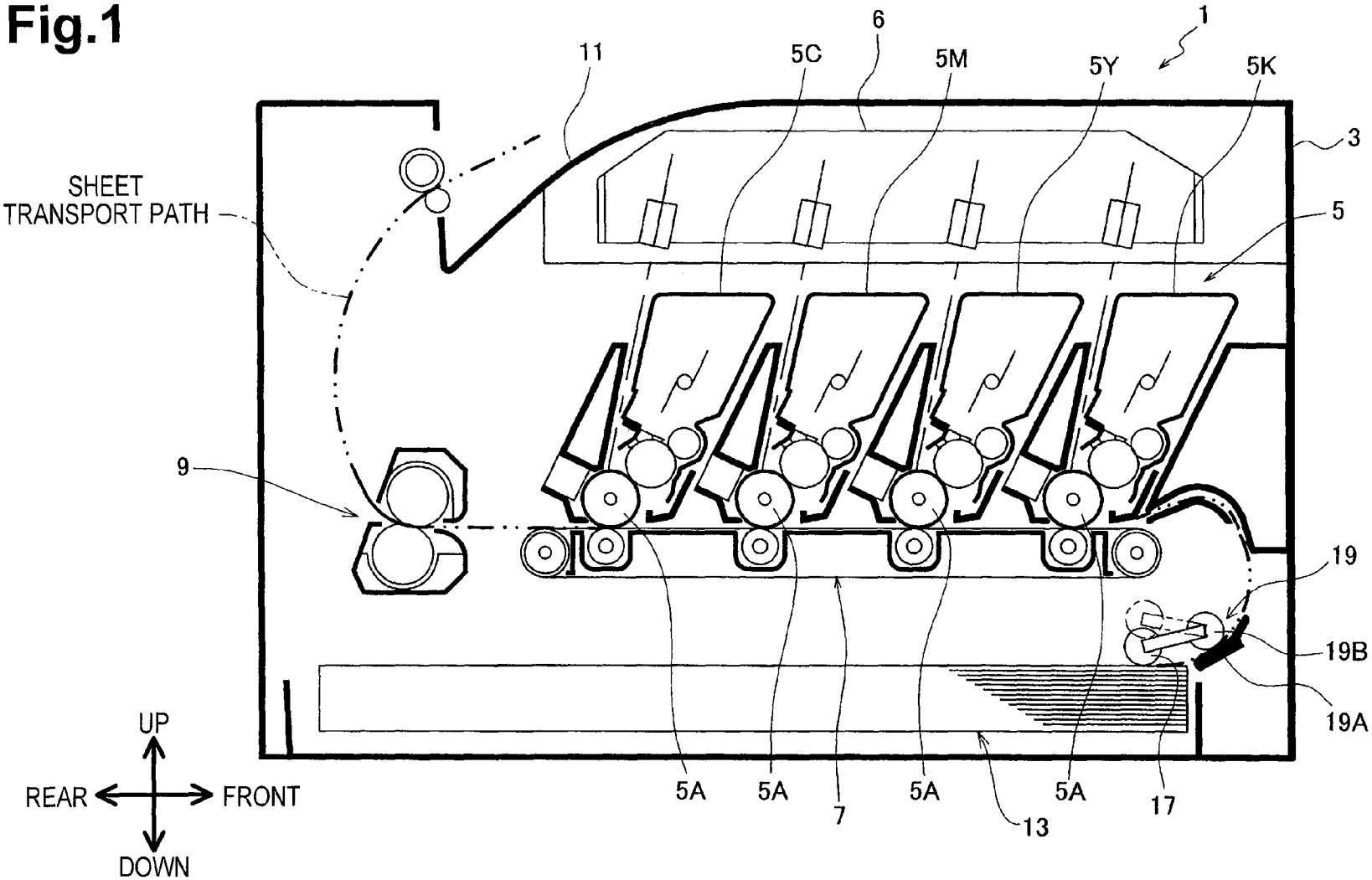
FIG. 1 is a central sectional view of an image forming apparatus according to an embodiment of the present invention.

As illustrated in FIG. 1, a casing 3 that constitutes an outer shape of an image forming apparatus 1 includes an image forming unit 5 inside for forming an image on a sheet of paper, an overhead projector (OHP) sheet, and so forth (hereinafter simply referred to as the sheet). The image forming unit 5 is electrophotographic image forming unit that forms an image by transferring a developer image.

The image forming unit 5 according to the present embodiment is a direct tandem image forming unit that includes four developing cartridges 5K, 5Y, 5M and 5C for a plurality of colors (four colors in the present embodiment, that is, black, yellow, magenta, and cyan) arranged in a sheet transportation direction and causing the developer image carried by each of the developing cartridges 5K, 5Y, 5M, and 5C to be directly transferred onto the sheet.

In a position opposite the image forming unit 5 (developing cartridges 5K, 5Y, 5M, 5C), a belt unit 7 for transporting the sheet is disposed. On a downstream side of the belt unit 7 in the sheet transportation direction, a fixing unit 9 is disposed. The fixing unit 9 is used to fix a developer onto the sheet by heating the sheet onto which the developer image has been transferred. When the developer has been fixed onto the sheet, the sheet is ejected from the casing 3 into a catch tray 11 disposed in an upper surface of the casing 3.

Each of the developing cartridges 5K, 5Y, 5M, and 5C includes a photoconductor drum 5A that carries the developer image. An exposure unit exposes the photoconductor drum 5A to light to form an electrostatic latent image on an outer peripheral surface of the photoconductor drum 5A. After that, the developer is supplied to the photoconductor drum 5A and the developer image is carried by the photoconductor drum 5A.

Figure 2:
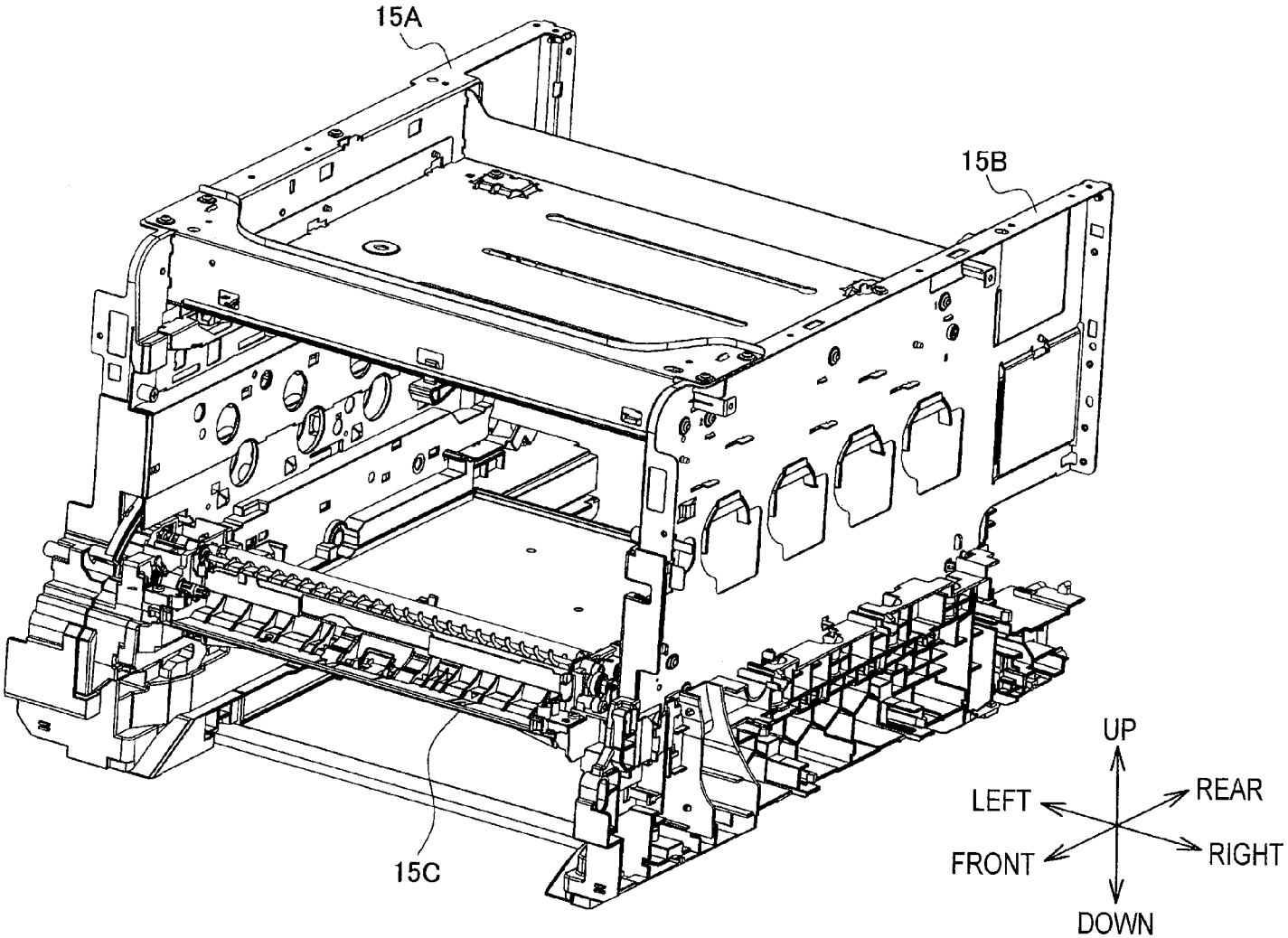
FIG. 2 is a perspective view illustrating main body frames and so forth of the image forming apparatus according to the embodiment of the present invention.

In addition, the image forming unit 5 is mounted on the first main body frame 15A and the second main body frame 15B which are disposed opposite each other so as to hold the image forming unit 5 therebetween in a horizontal direction. This horizontal direction, which will be hereinafter referred to as a width direction or a left-right direction is a direction perpendicularly intersects with the sheet transportation direction (refer to FIG. 2). As illustrated in FIG. 2, each of these first and second main body frames 15A and 15B have a plate-like shape that extends so as to substantially perpendicularly intersect with the width direction.

In the present embodiment, a resin material and a metal material are combined together to construct the first and second main body frames 15A and 15B in order to achieve both necessary strength and formability (productivity). The first and second main body frames 15A and 15B are connected to each other at least at upper end portions thereof, lower end portions thereof, and intermediate portions. The intermediate portions are positioned between the upper and lower end portions, that is, portions between the belt unit 7 and a sheet feed tray 13 in the present embodiment.

As illustrated in FIG. 1, the sheet feed tray 13, in which the sheets to be transported to the image forming unit 5 is loaded in a stack, is disposed in a position across the belt unit 7, opposite the image forming unit 5, and between the first and second main body frames 15A and 15B. The sheet feed tray 13 is removably mounted on an apparatus body.

The apparatus body herein generally refers to the first and second main body frames 15A and 15B, and members, devices and so forth mounted thereon.

A pick-up roller 17, which serves as a delivery roller that delivers the sheets to the image forming unit 5 by contacting a stack of the sheets loaded in the sheet feed tray 13 from an upper end in a sheet stack direction and by rotating. The pick-up roller 17 is mounted on a sheet feed frame 15C (refer to FIG. 2) such that the pick-up roller 17 can be displaced relative to the sheet feed tray 13 in the sheet stack direction.

As illustrated in FIG. 2, the sheet feed frame 15C extends from the first main body frame 15A to the second main body frame 15B so as to join the first main body frame 15A with the second main body frame 15B to form a bridge frame connected to both the first main body frame 15A and the second main body frame 15B. The sheet feed frame 15C is also included in the apparatus body in the present embodiment.

As illustrated in FIG. 1, a separator mechanism 19 is provided on the downstream side of the pick-up roller 17 in the sheet transportation direction. The separator mechanism 19 separates a plurality of sheets delivered by the pick-up roller 17 to supply the sheet to the image forming unit 5. The separator mechanism 19 includes a separator pad 19A, a separator roller 19B disposed in a position opposite the separator pad 19A, and so forth.

The separator pad 19A is a dragging member that applies a predetermined transportation dragging force to the plurality of sheets delivered by the pick-up roller 17 by contacting the side of the sheet opposing the other side of the sheet contacted by the pick-up roller 17 (printing surface side in the present embodiment). The separator roller 19B is a rotating member that contacts the side of the sheet the same as the pick-up roller 17 contacts (side opposite to the printing surface side in the present embodiment) and rotates while pressing the plurality of sheets against the separator pad 19A.

Figure 3:
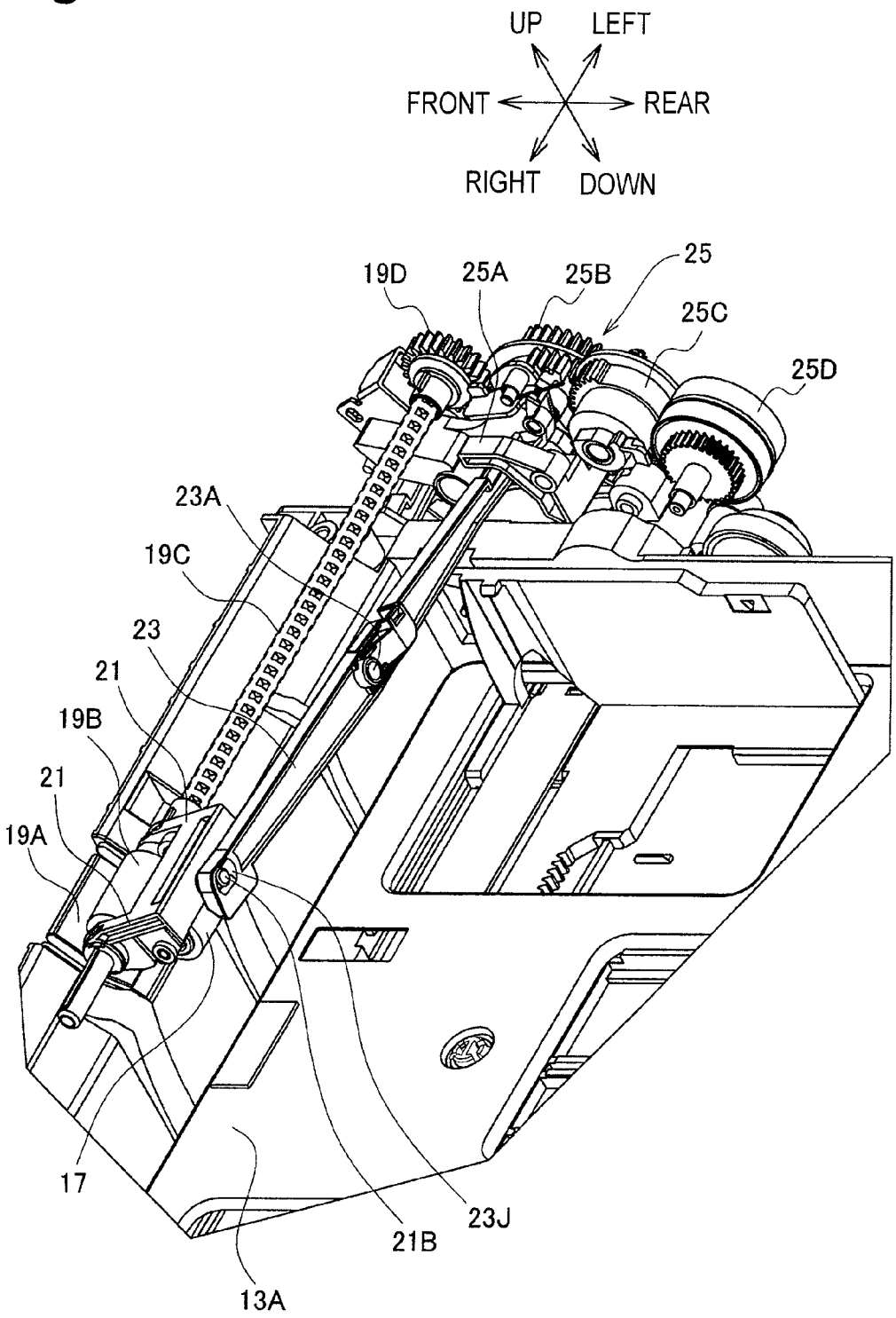
FIG. 3 is a schematic diagram illustrating a sheet feed device of the image forming apparatus according to the embodiment of the present invention.

As illustrated in FIG. 3, the separator roller 19B is positioned in a substantially central portion of the sheet feed tray 13 in the width direction and is rotated by a drive shaft 19C in a state in which the separator roller 19B is supported by the sheet feed frame 15C. The separator pad 19A is swingably mounted on a wall portion of the sheet feed tray 13 corresponding to the separator roller 19B. The first main body frame 15A, the second main body frame 15B, the sheet feed frame 15C, and so forth are omitted from FIG. 3.

Figure 4A:
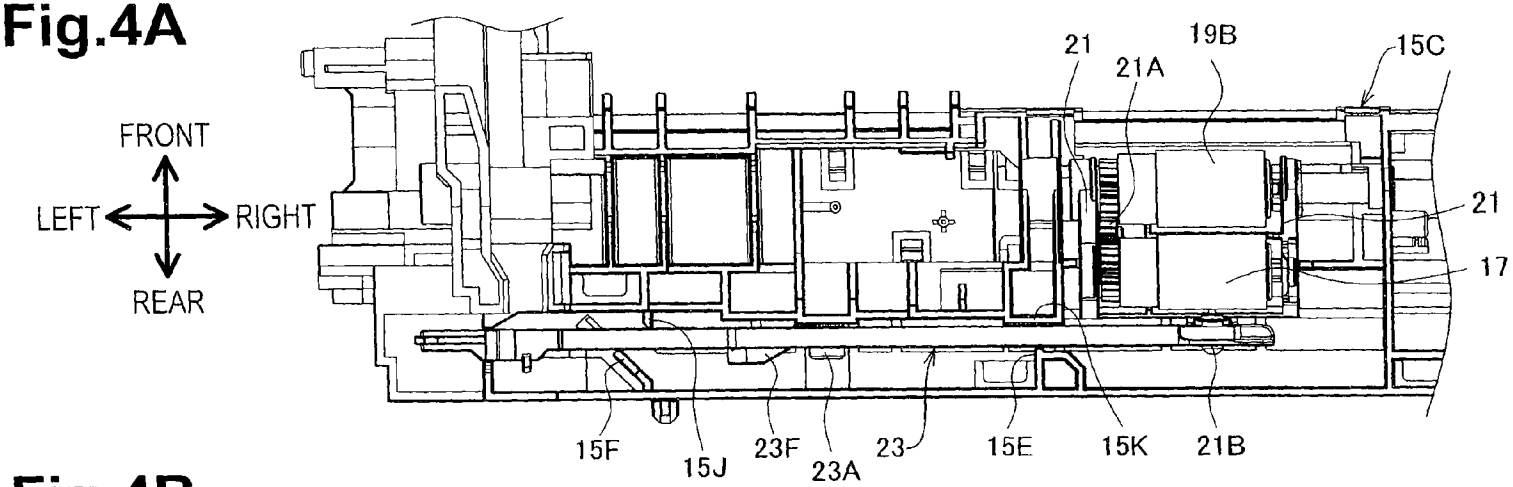
FIG. 4A is a bottom view illustrating a final mounting position of a lift arm that is mounted on a sheet feed frame of the image forming apparatus according to the embodiment of the present invention.

The pick-up roller 17, which is rotatably mounted on an end of a holder 21 that extends from the rotation center axis of the separator roller 19B toward an upstream side of the sheet transportation direction, is combined (integrated) into a unit with the separator roller 19B. The pick-up roller 17 is, as illustrated in FIG. 4A, rotated by torque obtained from the drive shaft 19C through a drive belt or a gear (an intermediate gear 21A in the present embodiment). The drive shaft 19C is omitted from FIG. 4A.

As illustrated in FIG. 3, a pressure panel 13A is provided in a bottom portion of the sheet feed tray 13. The pressure panel 13A is elevatable so as to displace the stack of the sheets loaded on the sheet feed tray 13 toward the pick-up roller 17. As described below, the pressure panel 13A is displaced from the bottom portion of the sheet feed tray 13 toward the pick-up roller 17 corresponding to a height reduction of the stack of the sheets loaded in the sheet feed tray 13.

Figure 5:
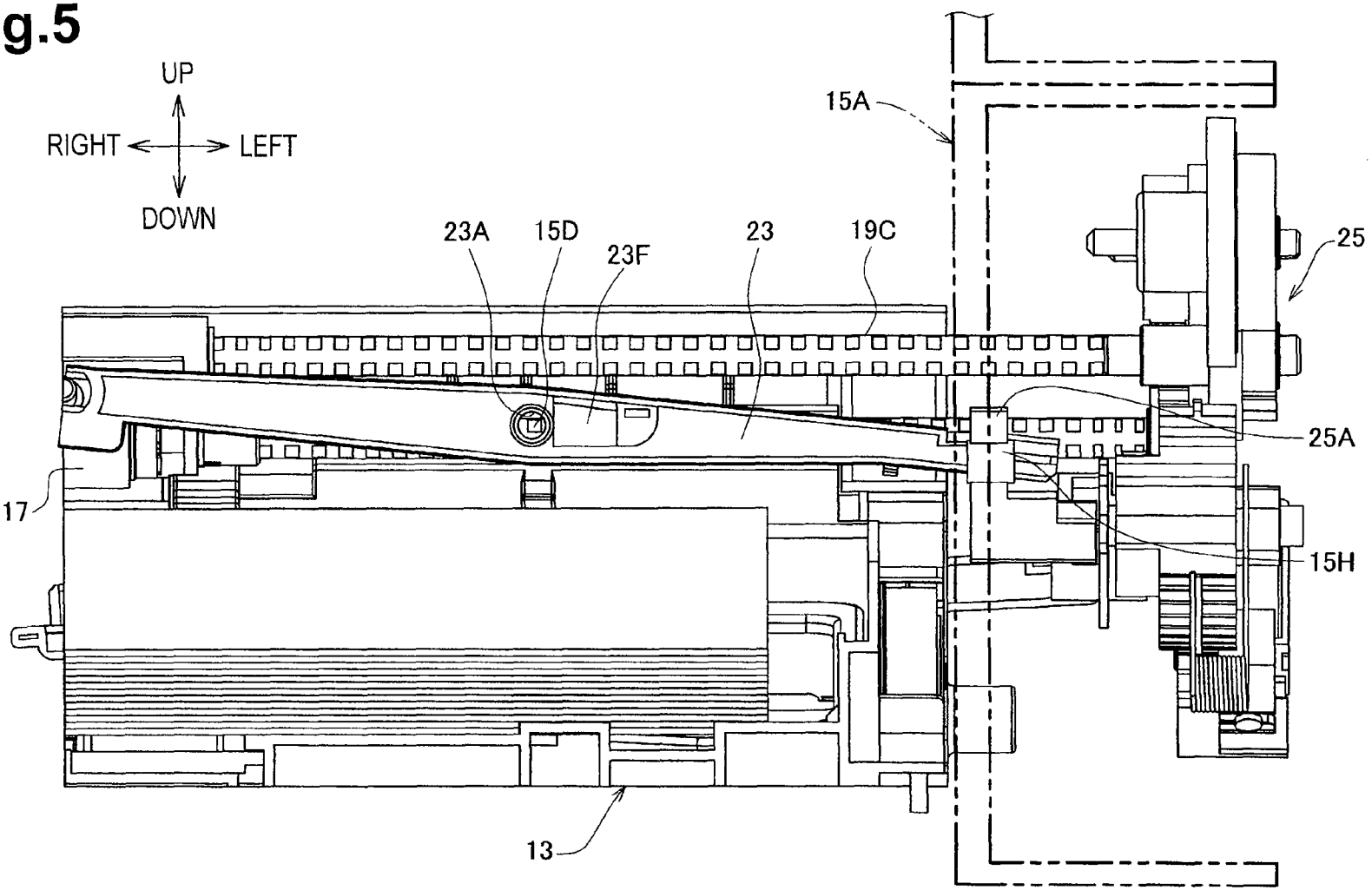
FIG. 5 is a schematic diagram illustrating the sheet feed device of the image forming apparatus according to the embodiment of the present invention.

As illustrated in FIG. 5, a drive mechanism 25 for displacing the pick-up roller 17 and the pressure panel 13A is provided on a side of the image forming apparatus 1 opposite a space in which the sheet feed tray 13, the image forming unit 5, and so forth are disposed across the first main body frame 15A. An operation of the drive mechanism 25 is transmitted to the pick-up roller 17 through a lift arm 23 that extends from the sheet feed tray 13 side toward the drive mechanism 25 side through the first main body frame 15A.

As illustrated in FIG. 3, one of longitudinal ends of the lift arm 23 is rotatably connected to the holder 21 while a substantially longitudinally central portion of the lift arm 23 is swingably supported at a lower surface side of the sheet feed frame 15C. Therefore, when the pick-up roller 17 is displaced to a lower position due to gravity or the like, the lift arm 23 swings and is displaced together with the pick-up roller 17. Thus, a displacement of the pick-up roller 17 is transmitted to the drive mechanism 25 side.

In the present embodiment, a sheet feed device that transports and supplies the sheet to the image forming unit 5 includes the pick-up roller 17, the separator pad 19A, the separator roller 19B, the lift arm 23, the drive mechanism 25, and so forth. This sheet feed device transports and supplies the sheet to the image forming unit 5 by separating the sheet at an end in the stack direction (the uppermost end in the present embodiment) from the other sheets loaded in a stack in the sheet feed tray 13.

2. Operation of Sheet Feed Device

Operation of the sheet feed device, that is, the operation of the pick-up roller 17, the separator pad 19A, the separator roller 19B, the lift arm 23, the drive mechanism 25, and so forth is the same as that of the technique disclosed, for example, in Japanese Unexamined Patent Application Publication 2006-176321. The outline of the technique will be described below.

The pick-up roller 17 contacts the uppermost sheet in the stack of the sheets loaded in the sheet feed tray 13 and rotates in order to apply a transportation force to the uppermost sheet. At this time, the pick-up roller 17 rotates while pressing the stacked sheets against the pressure panel 13A side. Therefore, the pick-up roller 17 delivers the plurality of the sheets including the uppermost sheet to a separator roller 19B side.

Out of the plurality of the sheets delivered by the pick-up roller 17, the separator roller 19B contacts the uppermost sheet in the stack direction and applies the transportation force that delivers the sheet to the image forming unit 5.

The separator pad 19A, which is disposed opposite the separator roller 19B, contacts the side of the sheet opposing the side of the sheet contacted by the separator roller 19B, and applies the transportation dragging force (frictional force) to the plurality of sheets. This suppresses delivery of the sheets positioned closer to the separator pad 19A than the sheet positioned uppermost in the stack direction and contacted by the separator roller 19B out of the sheets having been delivered by the pick-up roller 17 to the image forming unit 5.

When the sheet is not transported, the pick-up roller 17 enters a standby state (home position) in which the pick-up roller 17 has moved out of contact with the stack of the sheets. In contrast, when the sheet is transported, the pick-up roller 17 swings from the home position toward the pressure panel 13A side (lower side) to contact the stack of the sheets and rotate.

More specifically, the pick-up roller 17 is in the standby state when the other longitudinal end of the lift arm 23 (the drive mechanism 25 side) is retained by a lift lever 25A of the drive mechanism 25 (a state illustrated in FIG. 3). When the retained state is released, gravity acting on the pick-up roller 17 and a force acting on the holder 21 due to the rotation of the drive shaft 19C cause the holder 21 to swing toward the pressure panel 13A side (lower side). Thus, the pick-up roller 17 becomes in contact with the stack of the sheets (hereinafter, this state will be referred to as an operating state).

A force that rotates a pressure panel drive gear (not shown) for displacing the pressure panel 13A upward is transmitted from a drive motor (not shown) provided in the apparatus body through gears 25B to 25D and so forth by which the rotation speed of the drive motor is decelerated.

A clutch mechanism is provided for the gear 25B. The clutch mechanism switches a power transmission state between a state in which power is transmitted to a pressure panel drive gear side and another state in which the transmission of the power is cut off. The clutch mechanism cuts off the transmission of power if the other longitudinal end of the lift arm 23 (the lift lever 25A side) stays within a predetermined height range when the lift arm 23 is in the operating state.

The clutch mechanism, when the lift arm 23 is in the operating state, transmits power if the other longitudinal end of the lift arm 23 moves up beyond the predetermined height range, that is, if the pick-up roller 17 moves toward the pressure panel 13A side by a distance larger than or equal to a predetermined distance from the standby state position.

Therefore, when the number (height) of the sheets loaded in the sheet feed tray 13 is reduced and the pick-up roller 17 moves toward the pressure panel 13A side by a distance from the standby state position more than or equal to a predetermined distance, the pressure panel 13A is displaced upward. Thus, a distance from the sheet positioned uppermost in the stack direction loaded in the sheet feed tray 13 to the pick-up roller 17 is maintained within a predetermined range.

As described above, in the present embodiment, the lift arm 23 transmits an operation of the drive mechanism 25 performed for displacing the pick-up roller 17 to the pick-up roller 17 (holder 21) and is displaced by cooperating with the pick-up roller 17. Thus, a displacement amount of the pick-up roller 17 is transmitted to the clutch mechanism provided in the drive mechanism 25.

The clutch mechanism (drive mechanism 25) mechanically detects a position where the pick-up roller 17 comes into contact with the stack of the sheets loaded in the sheet feed tray 13 on the basis of a displacement amount of the lift arm 23, thereby detecting the number (height) of the sheets loaded in the sheet feed tray 13 and continuing or stopping the transmission of the power to the pressure panel drive gear. Thus, a distance from the sheet positioned uppermost in the stack direction loaded in the sheet feed tray 13 to the pick-up roller 17 is maintained within a predetermined range. The configuration for the detection in detail is described in incorporated U.S. Pat. No. 7,516,954.

Hereinafter, the above described operation of the lift arm 23, including the operation of transmitting the operation of the drive mechanism 25 to the pick-up roller 17 and the operation of swinging for detecting the position where the pick-up roller 17 comes into contact with the stack of the sheets, will be collectively referred to as a connected operation of the lift arm 23.

3. Configuration and Procedure for Mounting Lift Arm and so Forth

3.1. Configuration for Mounting Lift Arm and so Forth

Figure 6:
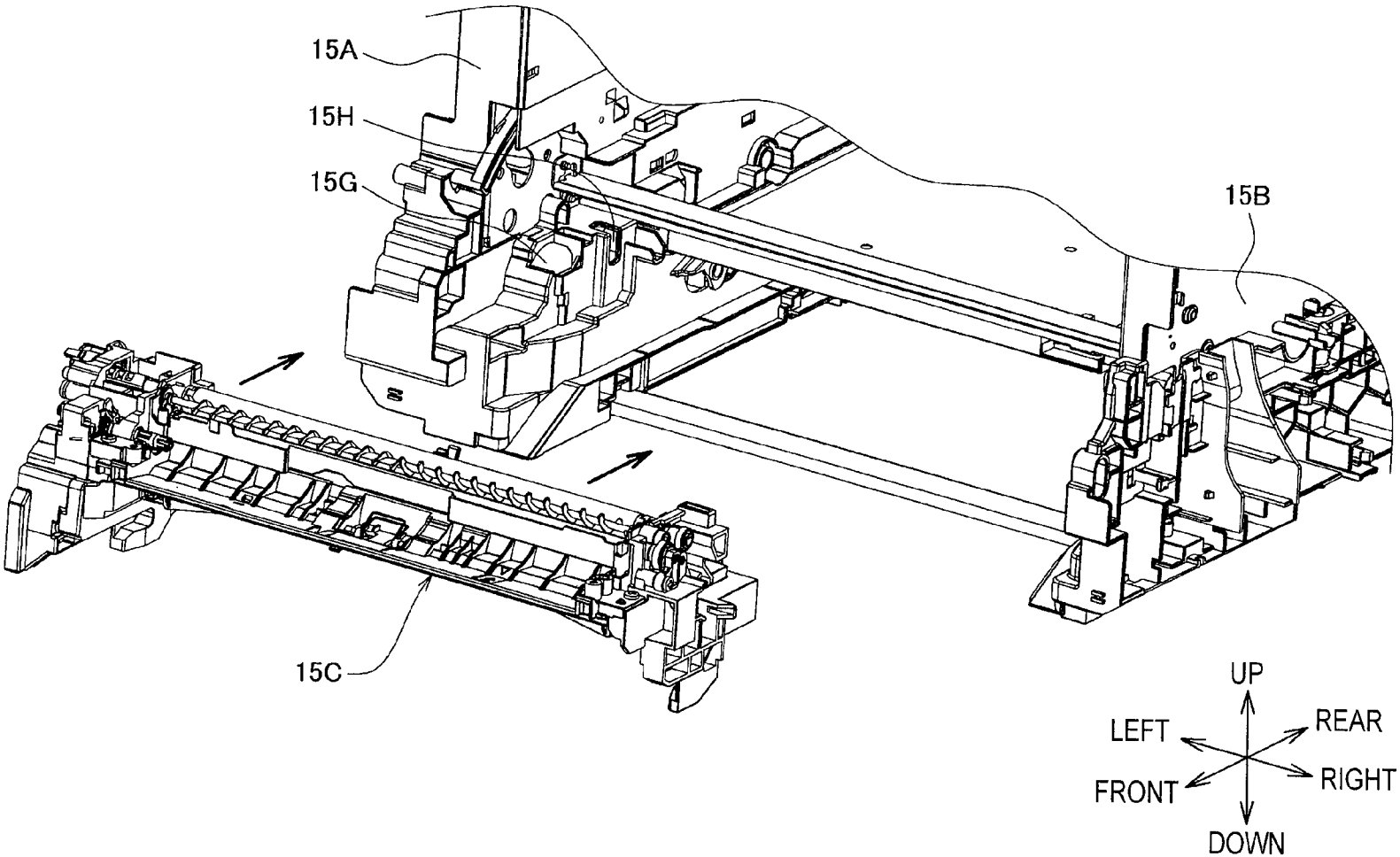
FIG. 6 is a diagram illustrating a state in which the sheet feed frame is removed from the image forming apparatus according to the embodiment of the present invention.

As illustrated in FIG. 6, the sheet feed frame 15C is removably mounted on the first main body frame 15A at one of longitudinal ends thereof and removably mounted on the second main body frame 15B at the other longitudinal end thereof. The sheet feed frame 15C is mounted on the first main body frame 15A and the second main body frame 15B so as to be mountable and removable in a direction perpendicular (front-rear direction in the present embodiment) to a direction from the first main body frame 15A toward the second main body frame 15B (width direction).

The sheet feed frame 15C is mounted on the first and second main body frames 15A and 15B by locating each other with protrusions provided on one side fitted into corresponding recesses provided on the other side. Then, the mounted state is maintained and secured by fastening member such as screws and so forth.

Since the lift arm 23 is swingably mounted on the sheet feed frame 15C, the lift arm 23 is mounted on the sheet feed frame 15C, and then the sheet feed frame 15C on which the lift arm 23 has been mounted is mounted on the first and second main body frames 15A and 15B in the present embodiment.

It is noted that, as described above, the lift arm 23 extends from the sheet feed tray 13 side through the first main body frame 15A to the drive mechanism 25 side (refer to FIG. 5). If the lift arm 23 is mounted on the sheet feed frame 15C in such a manner that the lift arm 23 can perform the connected operation, the lift arm 23 interferes with the first main body frame 15A when mounting of the sheet feed frame 15C on the first and second main body frames 15A and 15B is attempted.

The interference of the lift arm 23 with the first main body frame 15A may be avoided if, for example, a slotted hole-like cutout, which extends from a front side to a through hole 15H through which the lift arm 23 passes (refer to FIG. 6), is provided. However, this solution may significantly reduce the mechanical strength of the first main body frame 15A.

Figure 4B:
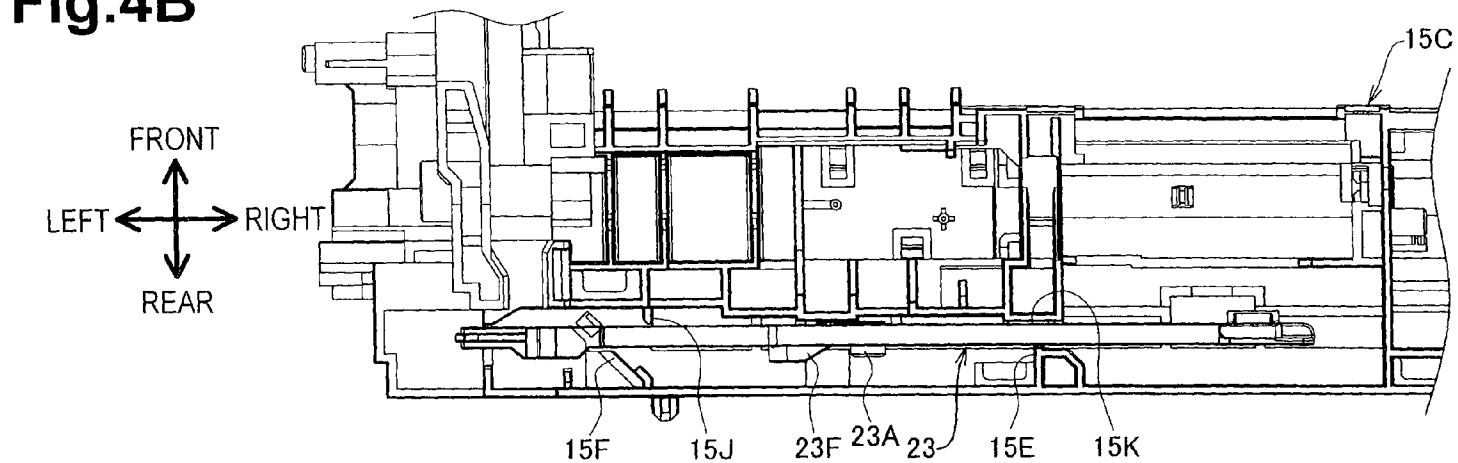
FIG. 4B is a bottom view illustrating a temporary mounting position of the lift arm to be mounted on the sheet feed frame of the image forming apparatus according to the embodiment of the present invention.

To avoid the interference, the present embodiment is structured such that the lift arm 23 can be displaced between the final mounting position (illustrated in FIG. 4A) and the temporary mounting position (illustrated in FIG. 4B). The final mounting position is a position where the lift arm 23 is supported by the sheet feed frame 15C and allowed to perform the connected operation. The temporary mounting position is a position that is offset from the final mounting position in the longitudinal direction of the lift arm 23 and where the entirety of the lift arm 23 is positioned between the first and second main body frames 15A and 15B. In addition, it is permitted to hold the lift arm 23 at the temporary mounting position in this structure.

More specifically, as illustrated in FIGS. 7A to 7C, a swing shaft 15D, which projects in the front-rear direction and swingably supports the lift arm 23, is provided in the sheet feed frame 15C. In the lift arm 23, a shaft hole 23A is provided. The swing shaft 15D is fitted into the shaft hole 23A when the lift arm 23 is positioned in the final mounting position.

Figures 8A, 8B, 8C:
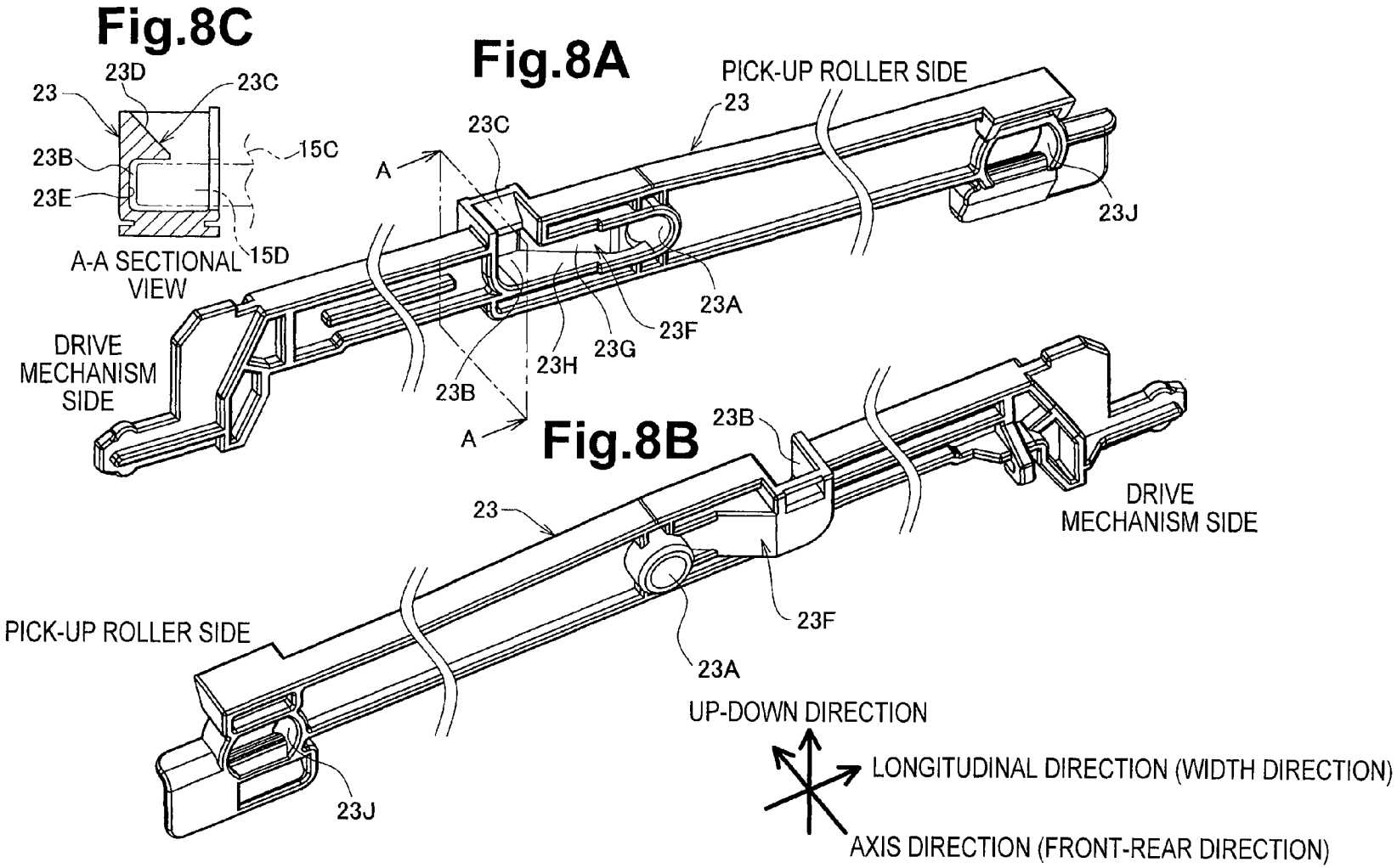
FIG. 8A is a perspective view illustrating the lift arm according to a first embodiment of the present invention as seen from a swing shaft side.
FIG. 8B is perspective view illustrating the lift arm according to the first embodiment of the present invention as seen from a side opposite the swing shaft side.
FIG. 8C is a sectional view of the lift arm according to the first embodiment of the present invention taken along line A-A of FIG. 8A.

As illustrated in FIGS. 8A and 8B, the lift arm 23 has a structure in which bending stiffness for bending about the axis of the swing shaft 15D (in the direction of the axis of the shaft hole 23A) is made to be greater than bending stiffness for bending about an axis (hereinafter referred to as an up-down axis) perpendicular to the longitudinal axis of the lift arm 23 and to the axis of the swing shaft 15D. This allows an elastic displacement in the direction of the axis of the swing shaft 15D to be easily performed in a portion of the lift arm 23 where the shaft hole 23A is provided compared to that performed in the longitudinal and up-down directions.

In the present embodiment, the entirety of the lift arm 23 is formed of a molded resin and a second moment of area about the axis of the swing shaft 15D is set to be smaller than that about the up-down axis. Thus, the bending stiffness for bending about the axis of the swing shaft 15D (in the direction of the axis of the shaft hole 23A) is made to be greater than bending stiffness for bending about the up-down axis.

A depression 23B is provided in a position offset from the shaft hole 23A (toward the drive mechanism 25 side) in the longitudinal direction of the lift arm 23. The depression 23B is used to hold the lift arm 23 in the temporary mounting position by receiving the swing shaft 15D that is fitted thereinto. Of the depression 23B, a shaft hole 23A side and one of ends in the up-down direction (upper end in FIG. 8A) are open.

As illustrated in FIG. 8C, a catcher 23C (an example of an engaging portion), which engages with the swing shaft 15D when the swing shaft 15D enters the depression 23B, is provided at one end of the depression 23B in the up-down direction. An inclined surface 23D is provided on an upper side of the catcher 23C in the figure, the inclined surface 23D being inclined relative to the up-down direction in such a manner where, in the figure, the lower a position on the inclined surface 23D is, the closer the position is to the bottom side of the swing shaft 15D (sheet feed frame 15C).

Therefore, if at least one of the lift arm 23 and the swing shaft 15D (sheet feed frame 15C) is displaced (the lift arm 23 in the present embodiment) in the up-down direction in the figure so as to increase a contact surface pressure therebetween while a top end portion of the swing shaft 15D is in contact with the inclined surface 23D, the lift arm 23 bends in the axial direction due to generation of a component force in the axial direction in the inclined surface 23D. This causes an elastic displacement of the catcher 23C away from the swing shaft 15D (sheet feed frame 15C).

When the swing shaft 15D is pressed beyond the catcher 23C and reaches the lower surface side of the catcher 23C in the figure, the swing shaft 15D is fitted into the depression 23B and engages with the catcher 23C. Thus, the lift arm 23 is held in the temporary mounting position.

The depression 23B is provided with a blocked base portion 23E that, as illustrated in FIG. 7A, is in contact with a top end portion of the swing shaft 15D when the swing shaft 15D is fitted into the depression 23B, that is, the lift arm 23 is in the temporary mounting position.

In the sheet feed frame 15C, first control protrusions 15E and 15F (an example of a restriction protrusion, and an example of a protrusion), which slidably contact the lift arm 23 on a side axially opposite the side where the swing shaft 15D contacts, and second control protrusions 15J and 15K, which slidably contact the lift arm 23 on the side axially the same as the swing shaft 15D contacts, are provided in portions corresponding to positions offset from the depression 23B on both sides of the lift arm 23 in the longitudinal direction.

As illustrated in FIGS. 7A and 8A, a fitting guide 23F is provided on the shaft hole 23A side in the depression 23B. The fitting guide 23F guides the swing shaft 15D from the depression 23B to the shaft hole 23A when the lift arm 23 laterally moves from the temporary mounting position to the final mounting position. The fitting guide 23F is formed so as to have a groove-like shape that includes a sloping surface 23G that slidably contacts the top end of the swing shaft 15D and a pair of guide surfaces 23H that slidably contact the circumferential surface of the swing shaft 15D.

The sloping surface 23G is inclined relative to the longitudinal direction and the axial direction of the lift arm 23 so as to connect the base portion 23E of the depression 23B to a sheet feed frame 15C side of the shaft hole 23A. Therefore, when the lift arm 23 is displaced from the temporary mounting position to the final mounting position, the swing shaft 15D moves in the fitting guide 23F while keeping the top end portion thereof in contact with the sloping surface 23G.

At this time, part of a force that displaces the lift arm 23 to the shaft hole 23A is converted into a force in the axial direction at a portion where the swing shaft 15D contacts the sloping surface 23G, and the lift arm 23 bends so as to move away from the bottom of the swing shaft 15D (refer to FIG. 7B). This displaces the shaft hole 23A in the axial direction.

When the swing shaft 15D passes the fitting guide 23F and reaches the shaft hole 23A, the swing shaft 15D enters the shaft hole 23A and the original shape of the lift arm 23 is restored. Thus, the lift arm 23 is in the final mounting position where the swing shaft 15D is fitted into the shaft hole 23A (refer to FIG. 7C).

In addition, when the lift arm 23 is displaced from the temporary mounting position to the final mounting position, the circumference surface of the swing shaft 15D is slidably contacted by the pair of guide surfaces 23H and the lift arm 23 is slidably contacted by the first control protrusions 15E and 15F (refer to FIG. 7B). Thus, a displacement of the lift arm 23 from the temporary mounting position to the final mounting position is guided by the guide surfaces 23H and the first control protrusions 15E and 15F.

When the swing shaft 15D enters the shaft hole 23A and the original shape of the lift arm 23 is restored, and the lift arm 23 is in the final mounting position where the swing shaft 15D is fitted into the shaft hole 23A, the first control protrusions 15E and 15F contact the lift arm 23 on the side of the lift arm that is opposite the swing shaft 15D. This restricts or reduces the swing shaft 15D and the shaft hole 23A from moving out of a fitted position.

3.2. Procedure for Mounting Lift Arm and so Forth

Initially, before the sheet feed frame 15C is mounted on the first main body frame 15A and the second main body frame 15B, the lift arm 23 is mounted in the temporary mounting position (refer to FIG. 7A) and the drive shaft 19C is mounted on the sheet feed frame 15C. In this state, the pick-up roller 17 and the separator roller 19B are not mounted on the sheet feed frame 15C.

Next, after the sheet feed frame 15C with the lift arm 23 mounted thereon is mounted on the first main body frame 15A and the second main body frame 15B, the lift arm 23 is displaced toward the drive mechanism 25 side (refer to FIG. 7B) to be set in the final mounting position (refer to FIG. 7C). Thus, the end of the lift arm 23 can pass through the through hole 15H and reach a position in which the lift arm 23 can engage with the lift lever 25A.

The gear 19D (refer to FIG. 3), which is provided at the longitudinal end of the drive shaft 19C, meshes with a gear (not shown) in the drive mechanism 25 in a hole 15G (refer to FIG. 6) provided on the lower side of the first main body frame 15A. Therefore, the drive shaft 19C does not pass through the first main body frame 15A.

After that, the pick-up roller 17 and the separator roller 19B, which are integrated into a unit using the holder 21, are mounted on the sheet feed frame 15C, and the separator roller 19B and the drive shaft 19C are connected together.

Then, by engaging a cylindrically shaped protrusion 21B (refer to FIG. 3 and so forth) provided in the holder 21 with an engaging hole 23J (refer to FIG. 8A and so forth) provided in one of the longitudinal ends of the lift arm 23, the holder 21 (pick-up roller 17) and the lift arm 23 are connected together.

The drive mechanism 25 is mounted on the first main body frame 15A after the sheet feed frame 15C has been mounted on the first main body frame 15A and the second main body frame 15B.

4. Features of Image Forming Device of Present Embodiment

In the present embodiment, the lift arm 23 is structured such that the lift arm 23 can be displaced between the final mounting position where the lift arm 23 is supported by the sheet feed frame 15C and allowed to perform the connected operation with the pick-up roller 17, and a temporary mounting position, which is offset from the final mounting position in the longitudinal direction of the lift arm 23 and where the entirety of the lift arm 23 is positioned between the first and second main body frames 15A and 15B.

The lift arm 23 and the sheet feed frame 15C are structured such that the lift arm 23 can be held in the temporary mounting position. Therefore, by displacing the lift arm 23 from the temporary mounting position to the final mounting position when the lift arm 23 is held in the temporary mounting position, the lift arm 23 passes through the first main body frame 15A. Thus, the lift arm 23 can be completely mounted.

Thus, the lift arm 23 can be easily mounted, and the image forming device in which efficiency in mounting the lift arm 23 can be improved is achieved.

Also in the present embodiment, the guide surfaces 23H and the first control protrusions 15E and 15F are provided for the lift arm 23 and the sheet feed frame 15C as guiding mechanism that guides the displacement of the lift arm 23 from the temporary mounting position to the final mounting position. This can allow the lift arm 23 to be easily mounted in a reliable manner.

In addition, in the present embodiment, the sheet feed frame 15C includes the first control protrusions 15E and 15F that slidably contact the lift arm 23 on the side opposite the swing shaft 15D. These first control protrusions 15E and 15F can be used to control the displacement of the lift arm 23 away from the sheet feed frame 15C in a direction parallel to the axial direction of the swing shaft 15D.

In the present embodiment, a state in which the swing shaft 15D is fitted into the shaft hole 23A is thus held by the first control protrusions 15E and 15F. Therefore, a problem in that the lift arm 23 is moved out of the sheet feed frame 15C after the lift arm 23 has been completely mounted can be reduced from occurring while efficiency in mounting the lift arm 23 can be improved.

In the present embodiment, the shaft hole 23A can be displaced in a direction parallel to the axial direction by bending the lift arm 23 in the axial direction. In addition, the lift arm 23 is provided with the fitting guide 23F having the sloping surface 23G. Thus, part of the force that displaces the lift arm 23 from the temporary mounting position to the final mounting position can be converted into that of the axial direction to axially displace the shaft hole 23A.

By doing this, in the present embodiment, since the fitting guide 23F causes the shaft hole 23A to be automatically displaced in a direction parallel to the axial direction when the lift arm 23 is mounted on the sheet feed frame 15C, efficiency in mounting the lift arm 23 can be further improved.

Here, "the force that displaces the lift arm 23 from the temporary mounting position to the final mounting position" refers to a force exerted by a human assembling operator, an automatic assembling apparatus, and so forth on the lift arm 23 so as to displace the lift arm 23 from the temporary mounting position to the final mounting position.

In the present embodiment, the lift arm 23 has a structure in which the bending stiffness for bending about the axis of the swing shaft 15D is made to be greater than bending stiffness for bending about an axis perpendicular to the longitudinal axis of the lift arm 23 and to the axis of the swing shaft 15D. This allows an elastic deformation of the lift arm 23 in the direction of the axis of the swing shaft 15D to be easily performed.

As described above, in the present embodiment, the shaft hole 23A is displaced in the direction of the axis of the swing shaft 15D in mounting the lift arm 23 to the sheet feed frame 15C. Since the lift arm 23 can be easily elastically deformed in the direction of the axis of the swing shaft 15D, the shaft hole 23A can be easily elastically displaced. Thus, the lift arm 23 can be easily mounted.

In addition in the present embodiment, the depression 23B, which is part of holding mechanism, can be elastically displaced by bending the lift arm 23 and includes the catcher 23C that engages with the swing shaft 15D. Therefore, as described above, the catcher 23C is elastically displaced so as to move away from the bottom of the swing shaft 15D in mounting the swing shaft 15D on the depression 23B. Thus, the lift arm 23 can be easily held in the temporary mounting position.

In the present embodiment, one of the longitudinal ends of the sheet feed frame 15C is removably mounted on the first main body frame 15A and the other longitudinal end thereof is removably mounted on the second main body frame 15B. Furthermore, the sheet feed frame 15C is removably mounted on the first main body frame 15A and the second main body frame 15B in a direction perpendicular to the direction extending from the first main body frame 15A toward the second main body frame 15B (front-rear direction).

By doing this, as described above, the sheet feed frame 15C is mounted on the first main body frame 15A and the second main body frame 15B after assembly of the first main body frame 15A and the second main body frame 15B has been completed in the present embodiment.

Therefore, after the sheet feed frame 15C has been assembled, the assembled sheet feed frame 15C is mounted on the first main body frame 15A and the second main body frame 15B. This can improve efficiency of the assembly compared to a case in which the sheet feed frame 15C is being assembled while the first main body frame 15A and the second main body frame 15B are also being assembled.

In the present embodiment, the pick-up roller 17 and the separator roller 19B are integrated into a unit. This allows the pick-up roller 17 and the separator roller 19B to be removed as a unit when the lift arm 23 is in the temporary mounting position.

By doing this, the pick-up roller 17 and the separator roller 19B can be removed as a unit in the present embodiment, a roller unit can be easily replaced and the maintainability of the image forming apparatus can be improved.

5. Relationship between Matters Specifying Claims and Matters Used in Embodiment In the present embodiment, the sheet feed tray 13 corresponds to a sheet placing portion described in the claims, the lift arm 23 corresponds to a link arm described in the claims, the sheet feed frame 15C corresponds to a bridge frame described in the claims, and the depression 23B, the first control protrusions 15E and 15F, and so forth constitute holding mechanism.

In addition, the temporary mounting position also corresponds to a first position described in the claims, and the final mounting position also corresponds to a second position described in the claims In addition, the guide surfaces 23H and the first control protrusions 15E and 15F constitute guiding mechanism described in the claims, the pick-up roller 17 corresponds to a feed roller described in the claims, the drive mechanism 25 corresponds to drive mechanism and mechanical detecting mechanism described in the claims, and the protrusion 21B and the engaging hole 23J constitute connecting mechanism described in the claims.

Second Embodiment

In the first embodiment, to engage the holder 21 with the lift arm 23, the engaging hole 23J side of the lift arm 23 needs to be bent so as to move away from the holder 21. In a second embodiment, the protrusion 21B and the engaging hole 23J can be engaged or disengaged without bending the lift arm 23.

Figure 9A:
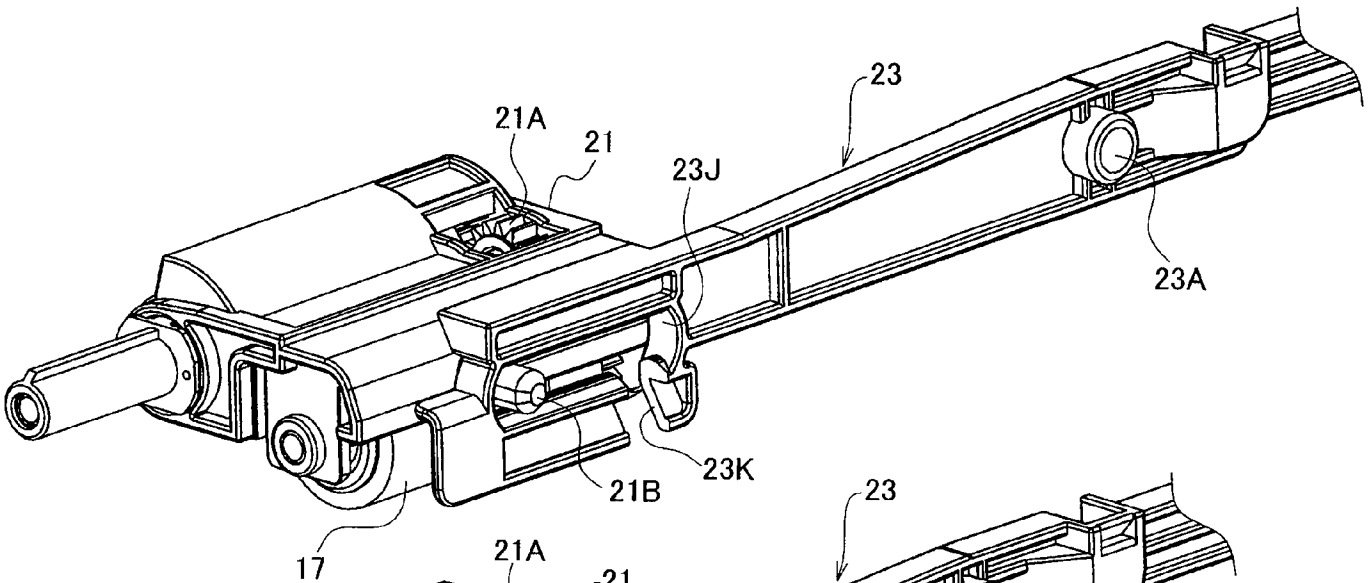
FIG. 9A is a perspective view illustrating the lift arm in the final mounting position according to a second embodiment of the present invention.
Figure 9B:
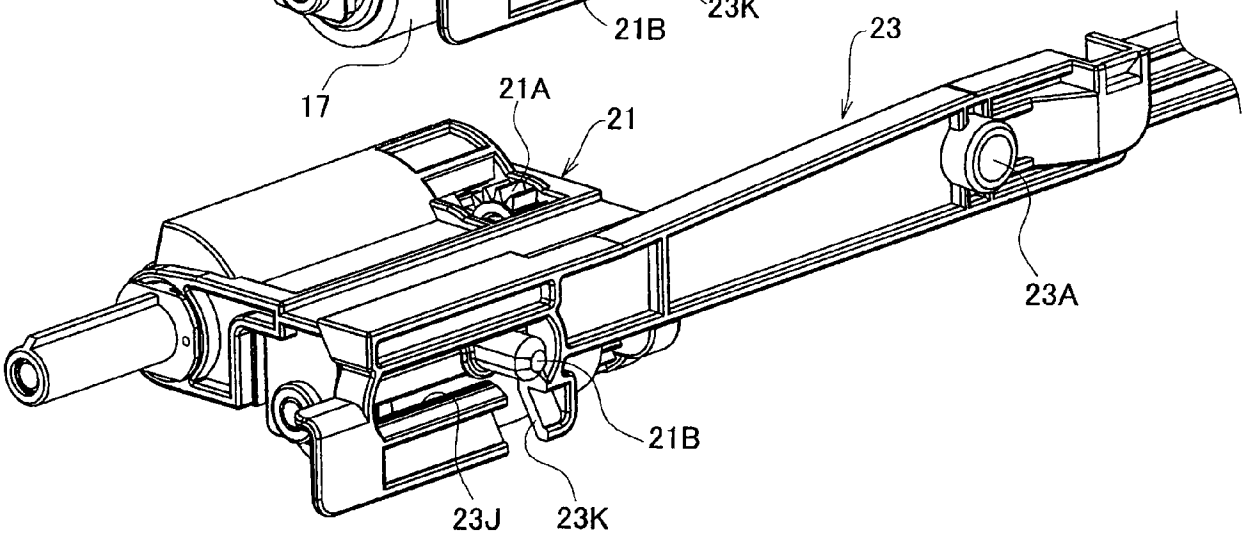
FIG. 9B is a perspective view illustrating the lift arm in the temporary mounting position according to the second embodiment of the present invention.

In other words, as illustrated in FIG. 9A, the engaging hole 23J is formed so as to have an elongated shape extending in the longitudinal direction of the lift arm 23 and is provided with a cutout 23K in a portion thereof. As illustrated in FIG. 9B, the position of the cutout 23K is set such that the position of the cutout 23K corresponds to that of the protrusion 21B when the lift arm 23 is in the temporary mounting position.

By doing this, when the lift arm 23 is in the final mounting position, the protrusion 21B and the engaging hole 23J are engaged with each other as illustrated in FIG. 9A, and the pick-up roller 17 and the lift arm 23 enter a connected state in which the connected operation can be performed. In contrast, when the lift arm 23 is in the temporary mounting position, the connected state is released as illustrated in FIG. 9B, and the pick-up roller 17 can be removed from the sheet feed frame 15C.

Therefore, in the present embodiment, the protrusion 21B and the engaging hole 23J can be disengaged (disconnected) from each other without bending the lift arm 23. This allows the pick-up roller 17 to be removed while the lift arm 23 is left in the sheet feed frame 15C. Thus, the maintainability of the image forming apparatus is improved in cases where replacement or the like of the pick-up roller 17 is performed because of the degradation of the pick-up roller 17.

Other Embodiments

In the above-described embodiments, while the swing shaft 15D is fitted into the depression 23B, the base portion 23E and the top end portion of the swing shaft 15D are in contact with each other. However, that does not limit the present invention. The bottom of the swing shaft 15D, while the swing shaft 15D is fitted into the depression 23B, may contact the depression 23B at a portion corresponding to the bottom portion of the swing shaft 15D (hereinafter this portion will be referred to as an opening portion of the depression 23B). In such a case, the top end of the swing shaft 15D comes into contact with the sloping surface 23G in an intermediate stage of the displacement of the lift arm 23 from the temporary mounting position to the final mounting position. Alternatively, the opening portion of the depression 23B may have an inclined surface similar to the sloping surface 23G so as to form part of a cam.

In the above-described embodiments, the depression 23B, which constitutes part of the holding mechanism, is provided in the lift arm 23, and the first control protrusions 15E and 15F, which also constitute part of the holding mechanism, are provided in the sheet feed frame 15C. However, that does not limit the present invention. The holding mechanism may be provided in only one of the lift arm 23 and the sheet feed frame 15C.

In the above-described embodiments, the guide surfaces 23H, which constitute part of the guiding mechanism, are provided in the lift arm 23, and the first control protrusions 15E and 15F, which also constitute part of the guiding mechanism, are provided in the sheet feed frame 15C. However, that does not limit the present invention. The guiding mechanism may be provided in only one of the lift arm 23 and the sheet feed frame 15C.

In the above-described embodiments, the swing shaft 15D is provided in the sheet feed frame 15C, and the shaft hole 23A is provided in the lift arm 23. However, that does not limit the present invention. The shaft hole 23A may be provided in the sheet feed frame 15C, and the swing shaft 15D may be provided in the lift arm 23.

In the above-described embodiments, the second moment of area about the axis of the swing shaft 15D is set to be smaller than that about the up-down axis. Thus, the bending stiffness about the axis of the swing shaft 15D is made to be greater than that about the longitudinal axis and that about the up-down axis. However, that does not limit the present invention. For example, the bending stiffness about the axis of the swing shaft 15D may be increased by insert-molding a metal member.

In the above-described embodiments, the lift arm 23 elastically bends when the lift arm 23 is displaced from the temporary mounting position to the final mounting position. However, that does not limit the present invention. For example, the bottom of the shaft hole 23A may be formed so as to have a flat spring-like structure so as to elastically displace a portion where the shaft hole 23A is provided.

In the above-described embodiments, the lift arm 23 transmits the operation of the drive mechanism 25 to the pick-up roller 17 and transmits the displacement amount of the pick-up roller 17 to the drive mechanism 25 (detecting mechanism). However, that does not limit the present invention. The technique disclosed herein may also be applicable to, for example, an image forming apparatus that does not move the pick-up roller 17 up and down in cooperation with a sheet feeding operation, that is, the drive mechanism 25 (detecting mechanism) only transmits the displacement amount of the pick-up roller 17 to displace the pressure panel 13A.

The present invention is not limited to the above-described embodiment. Embodiments are allowable as long as they do not depart from the gist of the invention described in the claims.

What is claimed is:

1. An image forming apparatus for forming an image on a recording sheet, comprising:

an image forming unit configured to form an image;

a first main body frame and a second main body frame disposed to hold the image forming unit therebetween;

a sheet placing portion disposed between the first main body frame and the second main body frame and configured to hold the recording sheet thereon;

a feed roller configured to feed the recording sheet held on the sheet placing portion toward the image forming unit and to move relative to the sheet placing portion;

a link arm configured to extend through the first main body frame from a side of the sheet placing portion to a side opposite the sheet placing portion across the first main body frame, the feed roller being configured to move with the link arm; and a bridge frame configured to extend to join the first main body frame with the second main body frame and to swingably support the link arm, wherein the link arm is movable between a temporary mounting position, in which the entirety of the link arm is positioned between the first main body frame and the second main body frame, and a final mounting position offset from the temporary mounting position in a longitudinal direction of the link arm, wherein in the final mounting position, the link arm is supported by the bridge frame and cooperates with the feed roller, and wherein at least one of the link arm and the bridge frame is provided with a holding mechanism configured to hold the link arm in the temporary mounting position.

2. The image forming apparatus according to claim 1, further comprising a guiding mechanism positioned at at least one of the link arm and the bridge frame and configured to guide movement of the link arm from the temporary mounting position to the final mounting position.

3. The image forming apparatus according to claim 2, wherein one of the link arm and the bridge frame includes a swing shaft configured to swingably support the link arm, and the other one of the link arm and the bridge frame includes a shaft hole into which the swing shaft is fitted, and wherein the bridge frame includes a restriction protrusion configured to constitute at least part of the guiding mechanism and, by swingably contacting the link arm from a side opposite to the swing shaft, to restrict the link arm from moving away from the bridge frame in a direction parallel to an axial direction of the swing shaft.

4. The image forming apparatus according to claim 3, wherein at least one of the swing shaft and the shaft hole is movable in the direction parallel to the axial direction, and wherein at least one of the link arm and the bridge frame includes a fitting guide configured to convert part of a force for moving the link arm from the temporary mounting position to the final mounting position into a force in the axial direction to move at least one of the swing shaft and the shaft hole in the axial direction.

5. The image forming apparatus according to claim 4, wherein the fitting guide is inclined relative to the axial direction and the longitudinal direction of the link arm.

6. The image forming apparatus according to claim 3, wherein the link arm is configured to have a greater bending stiffness for bending about the axis of the swing shaft than a bending stiffness for bending about an axis perpendicular to a longitudinal axis of the link arm and to the axis of the swing shaft.

7. The image forming apparatus according to claim 3, wherein the holding mechanism is elastically movable toward the one of the link arm and the bridge frame having the shaft hole, and wherein the holding mechanism has an engaging portion configured to engage with the swing shaft.

8. The image forming apparatus according to claim 1, wherein one longitudinal end of the bridge frame is removably mountable on the first main body frame and another longitudinal end of the bridge frame is removably mountable on the second main body frame, and wherein the bridge frame is removably mountable on the first main body frame and the second main body frame in a direction perpendicular to a direction extending from the first main body frame toward the second main body frame.

9. The image forming apparatus according to claim 1, further comprising a drive mechanism positioned on a side opposite the sheet placing portion and across the first main body frame and configured to move the feed roller, wherein operation of the drive mechanism is transmitted to the feed roller through the link arm.

10. The image forming apparatus according to claim 9, further comprising a connecting mechanism configured to connect the link arm to the feed roller, wherein the feed roller is removably mountable on the bridge frame, and wherein when the link arm is in the final mounting position, the connecting mechanism is in a connected state in which the operation of the drive mechanism is transmittable to the feed roller, and when the link arm is in the temporary mounting position, the connected state of the connecting mechanism is released and the feed roller is removable from the bridge frame.

11. The image forming apparatus according to claim 10, wherein the feed roller is integrated into a unit with a separator roller configured to separate the recording sheet fed by the feed roller one by one, and wherein the feed roller is removable as a unit with the separator roller when the link arm is in the temporary mounting position.

12. The image forming apparatus according to claim 1, further comprising a mechanical detecting mechanism positioned on a side opposite the sheet placing portion and across the first main body frame, and configured to detect a height of a stack of recording sheets held on the sheet placing portion by mechanically detecting a position where the feed roller comes into contact with the recording sheet held on the sheet placing portion, based on the amount of movement of the link arm.

13. An image forming apparatus for forming an image on a recording sheet, comprising:

an image forming unit configured to form an image;

a first main body frame and a second main body frame disposed to hold the image forming unit therebetween;

a sheet placing portion disposed between the first main body frame and the second main body frame and configured to hold the recording sheet thereon;

a feed roller configured to feed the recording sheet held on the sheet placing portion toward the image forming unit and to move relative to the sheet placing portion;

a link arm, wherein the feed roller is configured to move with the link arm; and a bridge frame configured to extend to join the first main body frame with the second main body frame and to swingably support the link arm, wherein the link arm is movable between a first position and a second position offset from the first position in a longitudinal direction of the link arm, wherein, in the second position, the link arm is configured to cooperate with the feed roller, wherein the link arm is configured to extend through the first main body frame from a side of the sheet placing portion to a side opposite to the sheet placing portion across the first main body frame.

14. The image forming apparatus according to claim 13, further comprising a holding mechanism positioned at at least one of the link arm and the bridge frame and configured to hold the link arm in the first position.

15. The image forming apparatus according to claim 13, wherein, in the first position, the entirety of the link arm is positioned between the first main body frame and the second main body frame.

16. The image forming apparatus according to claim 13, further comprising a guiding mechanism positioned at at least one of the link arm and the bridge frame and configured to guide movement of the link arm from the first position to the second position.

17. An image forming apparatus for forming an image on a recording sheet, comprising:

an image forming unit configured to form an image;

a first main body frame and a second main body frame disposed to hold the image forming unit therebetween;

a sheet placing portion disposed between the first main body frame and the second main body frame and configured to hold the recording sheet thereon;

a feed roller configured to feed the recording sheet held on the sheet placing portion toward the image forming unit and to move relative to the sheet placing portion;

a link arm, wherein the feed roller is configured to move with the link arm;

a bridge frame configured to extend to join the first main body frame with the second main body frame and to swingably support the link arm; and a guiding mechanism positioned at at least one of the link arm and the bridge frame and configured to guide movement of the link arm from a first position to a second position, wherein the link arm is movable between the first position and the second position, wherein the second position is offset from the first position in a longitudinal direction of the link arm, wherein, in the second position, the link arm is configured to cooperate with the feed roller, wherein one of the link arm and the bridge frame includes a swing shaft configured to swingably support the link arm, and the other one of the link arm and the bridge frame includes a shaft hole into which the swing shaft is fitted, and wherein the bridge frame includes a protrusion configured to constitute at least part of the guiding mechanism and, by swingably contacting the link arm from a side opposite to the swing shaft, to reduce the link arm from moving away from the bridge frame in a direction parallel to an axial direction of the swing shaft.

18. The image forming apparatus according to claim 17, wherein at least one of the swing shaft and the shaft hole is movable in the direction parallel to the axial direction, and wherein at least one of the link arm and the bridge frame includes a fitting guide configured to convert part of a force for moving the link arm from the first position to the second position into a force in the axial direction to move at least one of the swing shaft and the shaft hole in the axial direction.

19. The image forming apparatus according to claim 18, wherein the fitting guide is inclined relative to the axial direction and the longitudinal direction of the link arm.

* * * * *